US006261141B1

(12) United States Patent
Heap

(10) Patent No.: US 6,261,141 B1
(45) Date of Patent: Jul. 17, 2001

(54) ERGONOMIC KAYAK PADDLE

(75) Inventor: Aaron Heap, Logan, UT (US)

(73) Assignee: seven2, L.L.C., Logan, UT (US)

( * ) Notice: Subject to any disclaimer, the term of this patent is extended or adjusted under 35 U.S.C. 154(b) by 0 days.

(21) Appl. No.: 09/266,179

(22) Filed: Mar. 10, 1999

(51) Int. Cl.[7] ..... B63H 16/04
(52) U.S. Cl. ..... 440/101
(58) Field of Search ..... 114/347; 440/101, 440/102; 416/74, 69, 70 R; 16/111 R; 403/292, 345, 347, 367, 368; D12/215

(56) References Cited

U.S. PATENT DOCUMENTS

| | | | | |
|---|---|---|---|---|
| 300,915 | * | 6/1884 | Stanton | 416/70 R |
| D. 320,375 | * | 10/1991 | Bruce | D12/215 |
| 1,509,551 | * | 9/1924 | Gibson | 441/56 |
| 2,527,040 | * | 10/1950 | Swenson et al. | 416/74 |
| 2,711,547 | * | 6/1955 | Bliven | 416/74 |
| 3,052,897 | * | 9/1962 | Martin | 441/56 |
| 3,677,216 | * | 7/1972 | Gentemann | 440/102 |
| 4,147,469 | * | 4/1979 | Sherberne | 416/70 R |
| 4,673,361 | * | 6/1987 | Harvey | 440/101 |
| 4,701,142 | * | 10/1987 | Meritt | 440/101 |
| 4,842,482 | * | 6/1989 | Beckerer, Jr. | 416/70 R |
| 4,964,192 | * | 10/1990 | Marui | 16/111 R |
| 5,114,371 | * | 5/1992 | Alonzo | 441/129 |
| 5,348,503 | * | 9/1994 | Fechtner | 441/56 |
| 5,387,143 | * | 2/1995 | Pitman | 440/101 |
| 5,584,096 | * | 12/1996 | Aurora | 16/111 R |
| 5,842,830 | * | 12/1998 | Franznick | 416/74 |
| 5,979,015 | * | 11/1999 | Tamaribuchi | 16/110 R |

FOREIGN PATENT DOCUMENTS

| | | | | |
|---|---|---|---|---|
| 2599331 | * | 12/1987 | (FR) | 440/101 |
| 1308605 | * | 2/1973 | (GB) | 440/101 |

* cited by examiner

*Primary Examiner*—S. Joseph Morano
*Assistant Examiner*—Ajay Vasudeva
(74) *Attorney, Agent, or Firm*—Workman Nydegger Seeley

(57) ABSTRACT

A kayak paddle with a generally straight shaft that is preferably about 0.7 inches in diameter, the shaft is also conically tapered at either end. A left hand grip and a right hand grip are mounted on the shaft, and there is a blade at either end of the shaft. The blades each have a conically tapered socket to accept the tapered ends of the shaft. A portion of the socket remains vacant when the shaft is fully inserted, the vacant portion of the socket serves to trap sufficient air to ensure that the paddle will float. The mechanical connections thus formed prevent the shaft from rotating in the blade sockets and also minimize the amount of stress placed on the adhesive used to fix the shaft in the sockets. The grips ensure that the user's hands can be consistently placed and oriented on the shaft; because of the small diameter of the shaft, the user's hands can easily encircle the grips, and the user is thereby afforded a high degree of control over the paddle. Further, the grips are contoured so as to more ergonomically position the user's hands at natural gripping angles, with respect to the horizontal axis of the shaft; the natural gripping angles serve to minimize stresses on the user's wrists, hands, and arms. Additionally, the contours of the grips substantially prevent the user's hands from sliding along the shaft, and prevent the shaft from rotating in the user's hands. Finally, the grips have knuckle guards, preferably integrally formed with the grips, which serve to protect the user's hands in the event of an impact with obstructions such as rocks or trees.

27 Claims, 7 Drawing Sheets

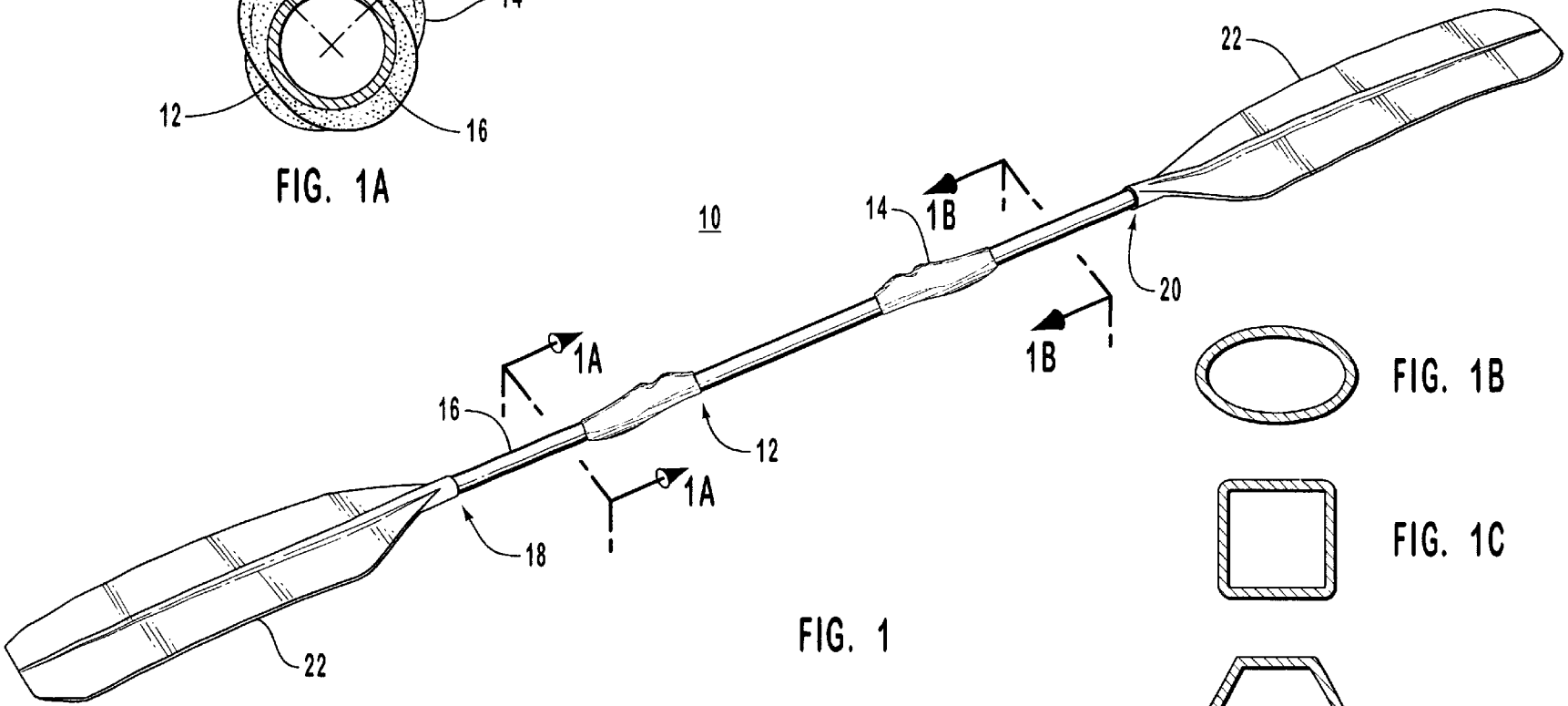
FIG. 1
FIG. 1B
FIG. 1C
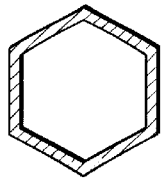
FIG. 1D
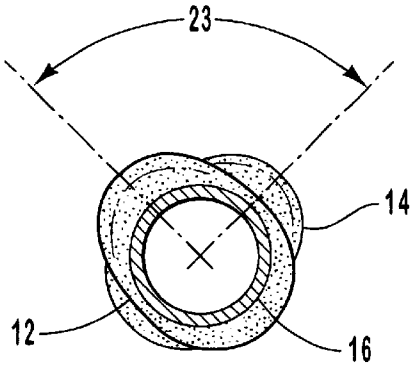
FIG. 1A

ERGONOMIC KAYAK PADDLE

BACKGROUND OF THE INVENTION

1. The Field of the Invention

The present invention relates generally to kayak paddles and particularly relates to an improved kayak paddle having an ergonomic grip arrangement to facilitate consistent and comfortable placement and orientation of the user's hands on the paddle.

2. The Relevant Technology

Kayakers exhibit a wide range of skill levels, from the recreational kayaker to the professional competitor. Kayaking enthusiasts pursue their sport in a variety of settings, including creeks, rivers, and the ocean. Each of the settings presents unique challenges to the kayaker. In creeks and rivers, the kayaker often faces swift currents, rapids, boulders, and snags. The sea kayaker may encounter strong tides, riptides, and high winds. These obstacles can present a serious threat to the safety of the kayaker who is ill-prepared to meet them.

In order to overcome these obstacles, it is essential that the kayaker be able to effectively control the kayak with a minimum of effort; this is no less true for the recreational kayaker than it is for the expert. The essential element in kayak control is the kayak paddle. A kayak paddle that the user can easily and efficiently employ will greatly facilitate control of the kayak.

It is generally acknowledged that the orientation of the kayaker's grip on the shaft of the kayak paddle is a critical factor in the useability and efficiency of kayak paddles. Accordingly, past efforts have been directed towards developing a shaft so formed as to provide the kayaker with a useful gripping means.

One common configuration is a round shaft that has been compressed in two places so as to deform the round cross-section, at those points, into generally oval-shaped cross-sections. The purpose of the oval cross sections is to provide regions where the user can more easily grasp the shaft. The oval grip portions are also intended to help visually indicate the points on the shaft where the user's hands should be placed. Finally, the grip portions aim to assure the user that the blades will be in the same position each time the grips are engaged, because the radial location of the grip portions, relative to the blades, is fixed.

Another typical configuration employs a round shaft with shims located on the shaft where the users's hands should be placed. The shims are typically secured in place on the shaft by something akin to a shrink wrap process. As with the oval-shaped sections discussed above, the purpose of the shims is both to facilitate gripping of the shaft, to help visually indicate where the user's hands should be placed, and to provide some assurance that the blades will be consistently positioned.

Finally, a more radical design uses a generally straight shaft which has bent portions near either end to provide gripping regions for the user's hands. The bent shaft has a generally round cross-section which flattens slightly through the gripping regions.

Although prior efforts have resulted in some improvement of the kayaker's grip on the shaft, each suffers from inadequacies. The oval cross-section and shim-type grip designs somewhat improve the kayaker's grip and help indicate where the kayaker's hands should be placed, but do little to prevent the user's hands from sliding longitudinally on the shaft. When the kayaker's hands are free to slide along the shaft, control and use of the paddle become very difficult, particularly in rough conditions such as rapids or whitewater. Even in calm conditions, the kayaker's hands tend to slide down the shaft during the draw stroke, that is, the stroke wherein the kayaker reaches forward with the shaft, dips the blade into the water and pulls, or draws, the shaft down and back. Because they are free to slide, the kayaker's hands tend to slip down the shaft during the draw stroke, rather than to push the shaft down into the water. Naturally, the problem of hand slippage is further aggravated when the shaft is wet, as is commonly the case. Hand slippage and the resulting loss of paddle and kayak control is a source of frustration for beginners and experts alike.

While the bent shaft grip configuration is somewhat more effective at reducing hand slippage than are the oval and shim-type grip configurations commonly used on straight shafts, the problem of hand slippage still has not been adequately addressed.

Another shortcoming of typical kayak paddle grip designs is the problem of shaft rotation. Shaft rotation occurs when kayak paddle blades are subjected to the forces exerted by wind and water; those forces act against the flat part of the blade, thereby imparting to the shaft a tendency to rotate about its longitudinal axis.

Shaft rotation is undesirable because it necessarily causes the blades, fixed to the ends of the shaft, to rotate out of position. Physically strong users can prevent this rotation to some extent by tightly gripping the shaft. However, gripping the shaft tightly to prevent rotation often involves a considerable expenditure of effort on the part of the user who is kayaking in strong currents and/or high winds, conditions commonly encountered by kayakers. In the more likely scenario, the user is unable to resist shaft rotation and is compelled to rotate the shaft to place the blades back into position. The necessity for frequent re-orientation of the shaft is, at least, a source of frustration, and could amount to a dangerous distraction in challenging conditions such as whitewater, rapids, or riptides.

The oval and shim-type grip designs provide little resistance to the shaft's inherent rotational tendency because their cross-sections are substantially similar to a purely circular cross-section, which offers virtually no impediment to shaft rotation. Nor does the bent shaft grip configuration resolve the problem of shaft rotation; the gripping regions of the bent shaft have a cross-section similar to that found in the oval and shim-type grip configurations and thus possess the same inherent lack of resistance to shaft rotation.

The inability of current designs to minimize or prevent shaft rotation, causes the user to lose a large measure of control over the paddle, and thus, over the kayak. Furthermore, by expending time and effort to frequently rotate the shaft back into position, the user also realizes an overall reduction in paddling efficiency. Lack of paddle and kayak control, and reduced paddling efficiency, inevitably result in user frustration and fatigue. Fatigue in particular, can become an important issue, for example, when the user is kayaking in open water and has to contend with strong tides and wind.

Kayak paddle shaft rotation, considered alone, is ample cause for concern to the kayaker. However, the natural and inevitable consequence of shaft rotation, out-of-position blades, is cause for concern as well. Blades which are out of position present a serious problem because they impede the kayaker's ability to respond to rapidly changing conditions. As an example, a kayaker whose craft is rushing towards a rock may have only a second or two to take evasive action;

if the paddle blades are out of position, the kayaker may be unable to timely execute the necessary maneuvers. Thus, kayakers must be able to quickly establish and easily maintain consistent blade orientation. Current kayak paddle grip designs do not meet this need.

Hand slippage and shaft rotation are the major unresolved concerns in the field, but there are a number of other problems that existing designs have not adequately addressed, or have not addressed at all. One such problem is that the typical grip design does little to reduce the often substantial stresses that kayaking places on the user's hands, wrists, and arms. If anything, these designs may tend to aggravate the problem. One reason for this is that the typical grips are relatively large in diameter and thus, difficult to grasp and hold. The shim-type grips are particularly bulky to grasp because the shim increases the diameter of the grip region, making the shaft difficult for the user to securely hold. Thus, the user is forced to grip the shaft tightly in order to be able to hold it; the user's tight grip consequently increases the stresses on the user's hands, wrists, and arms.

Not only does their bulk make typical grip configurations troublesome to grip and hold, but those configurations also force the user to grip along an unnatural horizontal line. Because most users' natural grip is along axes slightly oblique to a horizontal line, the horizontal grip induces unnecessary additional stress on the user's wrists, hands, and arms.

The grip spacing, that is, the space between the points at which the user grips the shaft, of typical grip arrangements also tends to force many users' hands and arms into unnatural positions. This is because the grip spacing in typical kayak paddle grip arrangements is generally calculated to provide a one-size-fits-all configuration; such designs are inherently unsuited to meet the ergonomic requirements of many users. Consequently, many users are forced to assume inefficient, unnatural postures on the shaft.

In sum, the bulky grips, generic grip spacing, and unnatural grip positions of the typical kayak paddle grip arrangements all conspire to impose unnecessary stresses on the user's hands, wrists, and arms. The results of this stress range from fatigue to repetitive-use injuries that require medical treatment.

A different type of problem with typical kayak paddle grip arrangements concerns the production processes by which those arrangements are fabricated. The bent shaft configuration is noteworthy in this regard. The air-bag inflated mold process used to produce bent shafts is complex and time-consuming. This type of production arrangement is not well-suited to rapid, high volume, mass production. Consequently, bent shaft kayak paddles are very expensive and thus practically unavailable to many kayakers.

Oval section and shim-type grip arrangements are somewhat simpler to manufacture than bent tubes, but as indicated earlier, involve a number of additional steps beyond the creation of a simple shaft. These additional steps necessarily increase the cost of these types of kayak paddle shafts. Not only are these grip arrangements labor-intensive and expensive to produce, but they also fail to make any provision for ergonomically positioning the user's hands on the shaft.

A final concern in the field of kayak paddles relates to the adhesive bond between the shaft and the blade socket in which it is inserted. It is the case with some designs that the stresses imposed on the paddle blades may break the adhesive bond between the shaft and the socket of the paddle blade in which the shaft is inserted. When the adhesive bond is broken, the shaft and blade are free to rotate with respect to each other, and the paddle is thereby rendered ineffective. The paddle must then be repaired or replaced.

SUMMARY AND OBJECTS OF THE INVENTION

It is a general object of the present invention to provide an improved kayak paddle to solve the aforementioned problems.

Accordingly, it is an object of the present invention to provide an improved kayak paddle with an ergonomic grip arrangement that facilitates consistent placement and orientation of the user's hands on the kayak paddle shaft.

It is similarly an object of the present invention to provide an improved kayak paddle with an ergonomic grip arrangement which, when engaged by the user, orients the user's hands along natural gripping axes.

It is an additional object of the present invention to provide an improved kayak paddle with an ergonomic grip arrangement that, when gripped by the user, substantially prevents the kayak paddle shaft from rotating in the user's hands.

It is finally an object of the present invention to provide an improved kayak paddle with an ergonomic grip arrangement that, when engaged by the user, substantially prevents the user's hands from sliding along the longitudinal axis of the shaft.

Other objects and advantages of the invention will become apparent upon reading the following detailed description and appended claims, and upon reference to the accompanying drawings.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which:

FIG. 1 is a top view of the kayak paddle, in accordance with the preferred embodiment of the present invention;

DETAILED DESCRIPTION OF THE PREFERRED EMBODIMENTS

Figure 2:
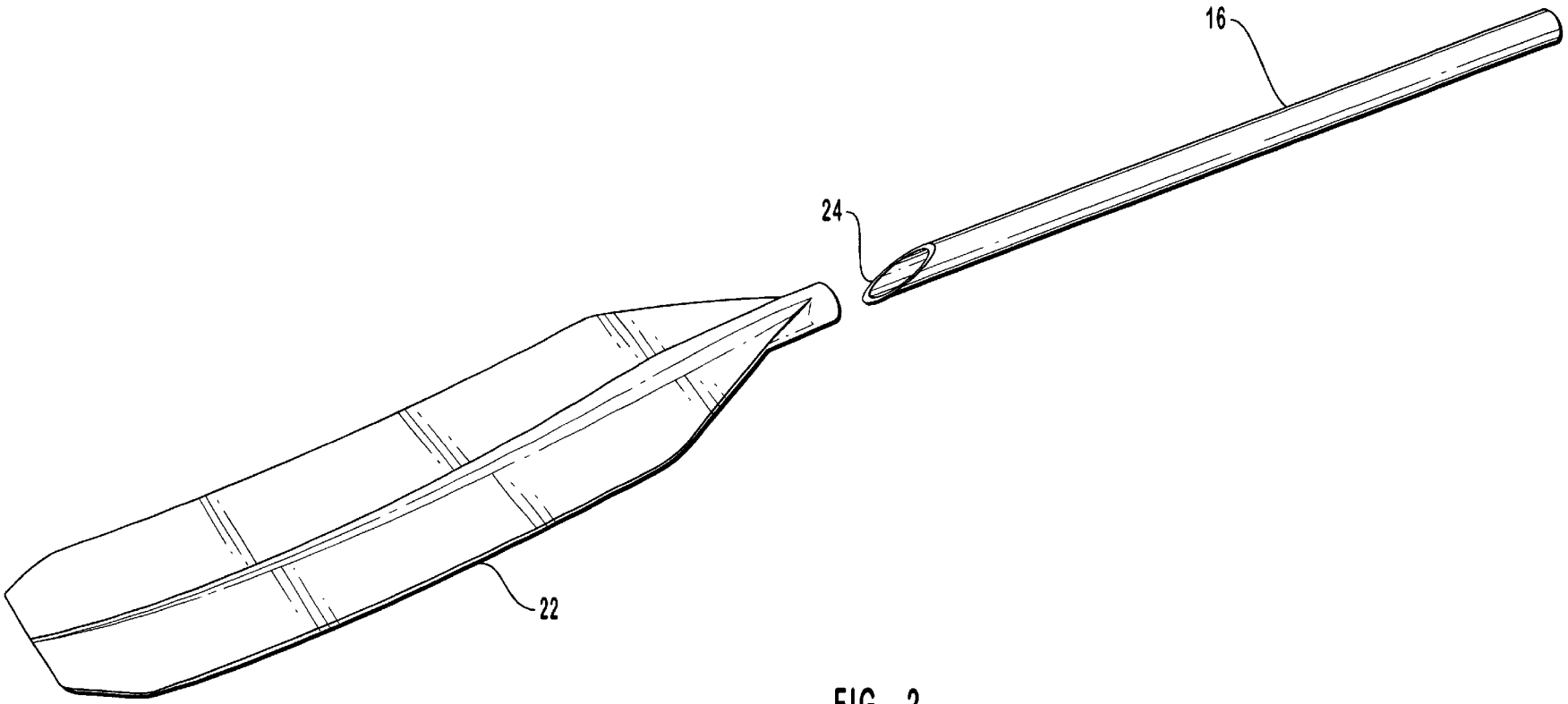
FIG. 2 is a top view of the shaft and tapered ends in accordance with an embodiment of the present invention.

The present invention relates to an improved kayak paddle with an ergonomic grip arrangement. FIGS. 1 through 6 show an ergonomic grip arrangement according to a preferred embodiment of this invention.

With reference to FIG. 1, a kayak paddle according to the present invention is depicted generally as 10. An ergonomic grip arrangement depicted generally as left hand grip element 12 and a right hand grip element 14 are mounted about an elongate shaft 16 having a first end 18 and a second end 20. In a preferred embodiment, elongate shaft 16 has a generally circular cross-section; however, elongate shafts having square, oval, or polygonal cross-sections, or combinations thereof, are also contemplated as being within the scope of this invention as indicated in FIGS. 1B, 1C, and 1D. Note that the left hand grip element 12 and the right hand grip element 14 are identical to each other in form and construction, but have been assigned different numbers in the interest of clarity. In a preferred embodiment, suitable means for securing the right hand grip element 14 and the left hand grip element 12 to the elongate shaft 16 include adhesive, double-backed tape, or the like. As indicated generally in FIG. 1, the left hand grip element 12 and the right hand grip element 14, when mounted about the elongate shaft 16, are axially distanced from the first end 18 of the elongate shaft 16 and the second end 20 of the elongate shaft 16, respectively, substantially equal distances. The outside diameter 34 (FIG. 3) of elongate shaft 16 is well-adapted to permit the user's hands to substantially encircle the left hand grip element 12 and the right hand grip element 14, respectively, when the left hand grip element 12 and the right hand grip element 14 are mounted about the elongate shaft 16; in a preferred embodiment, the outside diameter of the elongate shaft is in the range of about 0.6 inches to about 0.8 inches.

While a range of shaft diameters from about 0.6 inches to about 0.8 inches represents the preferred embodiment, this range should not be construed as a limitation; this invention contemplates yet smaller diameter shafts as improvements in materials and manufacturing processes are realized. Further, as technology progresses in the area of grip materials and manufacturing, it is also contemplated that the circumference of the grip elements may be reduced, thereby permitting correspondingly larger shaft diameters. Thus, shafts having diameters outside the preferred indicated range are considered to be within the scope of this invention.

Finally, with regard to the shape of the shaft, the preferred embodiment contemplates a substantially straight shaft. However, it is recognized that the grip elements may also be effectively employed if mounted on shafts which have hand-locating offsets; the offsets cooperating with the grips so as to locate the user's hands along the shaft, and orient the user's hands about the shaft, respectively. Accordingly, an offset shaft employing ergonomic grips is considered to be within the scope of this invention.

Attached to the elongate shaft 16 are two blades 22; one blade 22 is attached to the first end 18 of the elongate shaft 16, and one blade 22 is attached to the second end 20 of the elongate shaft 16. In the interest of clarity, the blades and grips of FIG. 1 are shown as being generally rotationally symmetric. However, those of skill in the kayaking art appreciate that left and right blades are generally not planar with each other; in fact, the left and right side blades and grips are typically rotationally offset several degrees from one another as indicated in FIG. 1A. Such rotational offset 23 between left and right side grips and blades is contemplated and is within the scope of the present invention. In a preferred embodiment, the rotational offset is in the range of about 45 degrees to about 90 degrees.

Figure 3:
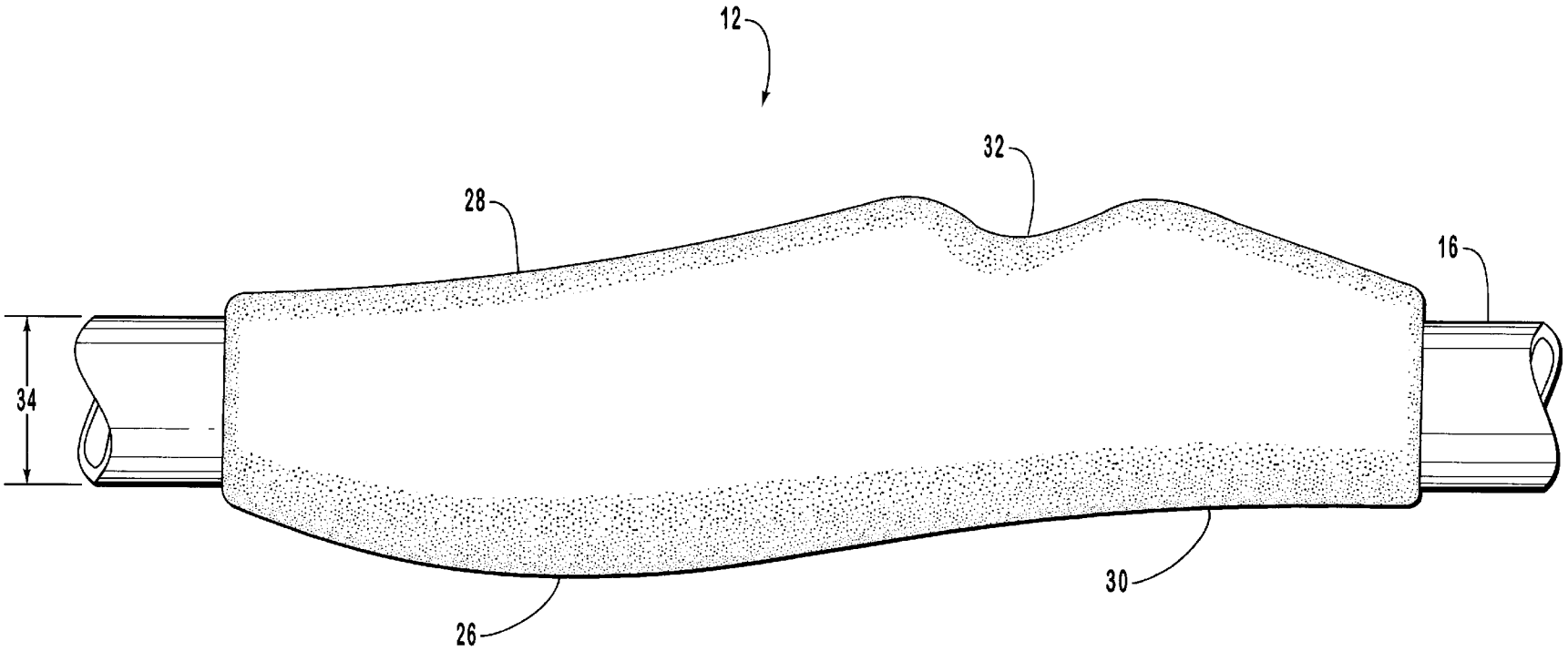
FIG. 3 is a top view of the left hand grip element in accordance with the preferred embodiment of the present invention.

The left hand grip element 12 and the right hand grip element 14 are in accord with FIG. 3. Note that while FIG. 3 depicts only the left hand grip element 12, the right hand grip element 14 (not shown) is similarly mounted about the elongate shaft 16, opposite the left hand grip element 12, as indicated generally in FIG. 1. As indicated in FIG. 3, the left hand grip element 12 has a generally cylindrical bore therethrough so as to facilitate mounting about the elongate shaft 16, the cylindrical bore being coaxial with the longitudinal axis of the elongate shaft 16. When the left hand grip element 12 and the right hand grip element 14 are mounted about the elongate shaft 16, hand-orienting indentations depicted generally as notches 32, generally having a vertex, serve to seat the left and right index fingers, respectively, of the user. Thus, the user's hands can be consistently placed and oriented on the elongate shaft 16 by touch alone. Furthermore, the notches 32 serve to desirably prevent the user's hands from sliding in either direction along the longitudinal axis of shaft 16. The notches 32 also cooperate with contours 26, 28, and 30 to desirably prevent the shaft 16 from rotating in the user's hands.

Figure 6:
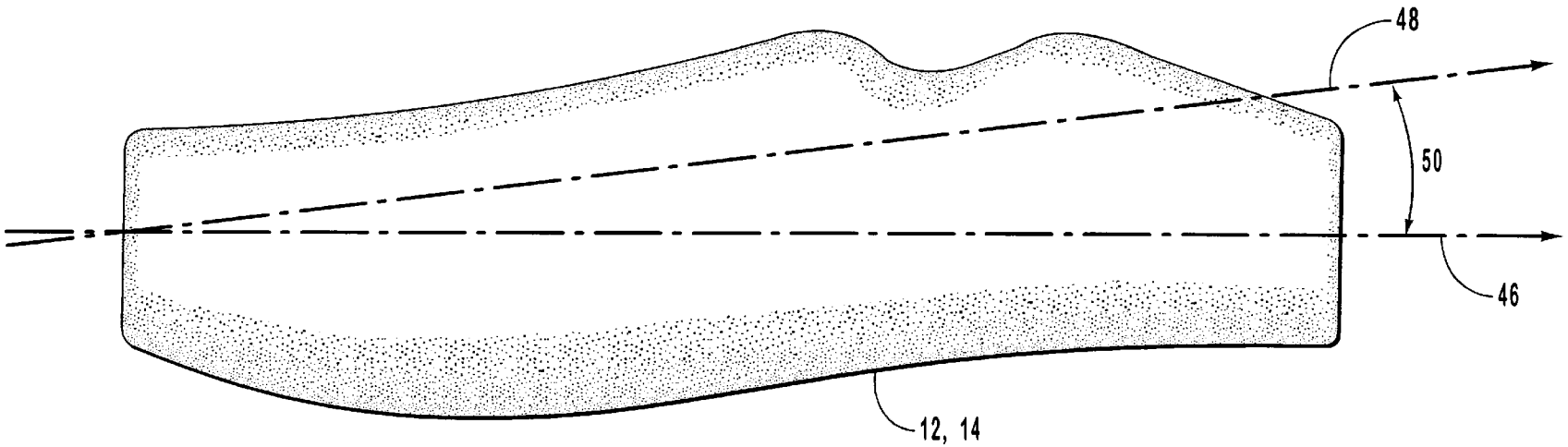
FIG. 6 depicts the horizontal and natural gripping axes in accordance with the preferred embodiment of the present invention.

FIGS. 3 and 6 depict the left hand grip element 12 and corresponding grip axis 48. While not shown in FIGS. 3 and 6, the right hand grip element 14 and the corresponding grip axis 48 are similarly disposed with respect to each other. Given these similarities and the fact that, as pointed out earlier, the left hand grip element 12 and the right hand grip element 14 are identical to each other in form and construction, the respective features of the left hand grip element 12 and the right hand grip element 14 will henceforth be referred to in the plural where necessary for clarity.

As indicated by FIGS. 3 and 6, the contours 26, 28 and 30 serve to position the user's hands along the user's natural grip axes 48, rather than along an unnatural horizontal line 46. The natural grip axes 48 are generally oblique to the horizontal line 46, so as to form acute angles 50. By positioning the user's grip along natural grip axes 48, the contours 26, 28, and 30 of the left hand grip element 12 and the right hand grip element 14 thereby significantly reduce stress on the user's hands, wrists and arms. In a preferred embodiment, the acute angles 50 are in the range of about 6 degrees to about 8 degrees, however, other angles including 0 degrees as well as exaggerated aggressive angles are contemplated within the scope of the present invention. Note that the acute angle 50, as generally depicted in FIG. 6, is exaggerated for the sake of clarity and should not be construed to be limited to the extent shown.

Finally, regarding construction of the ergonomic grip arrangement, the preferred embodiment of the left hand grip element 12 and the right hand grip element 14 permits the user's hands to substantially encircle the grips. However, ergonomic grips of larger circumference may be desired by some users for particular applications and are thus also contemplated as being within the scope of this invention.

Figure 4:
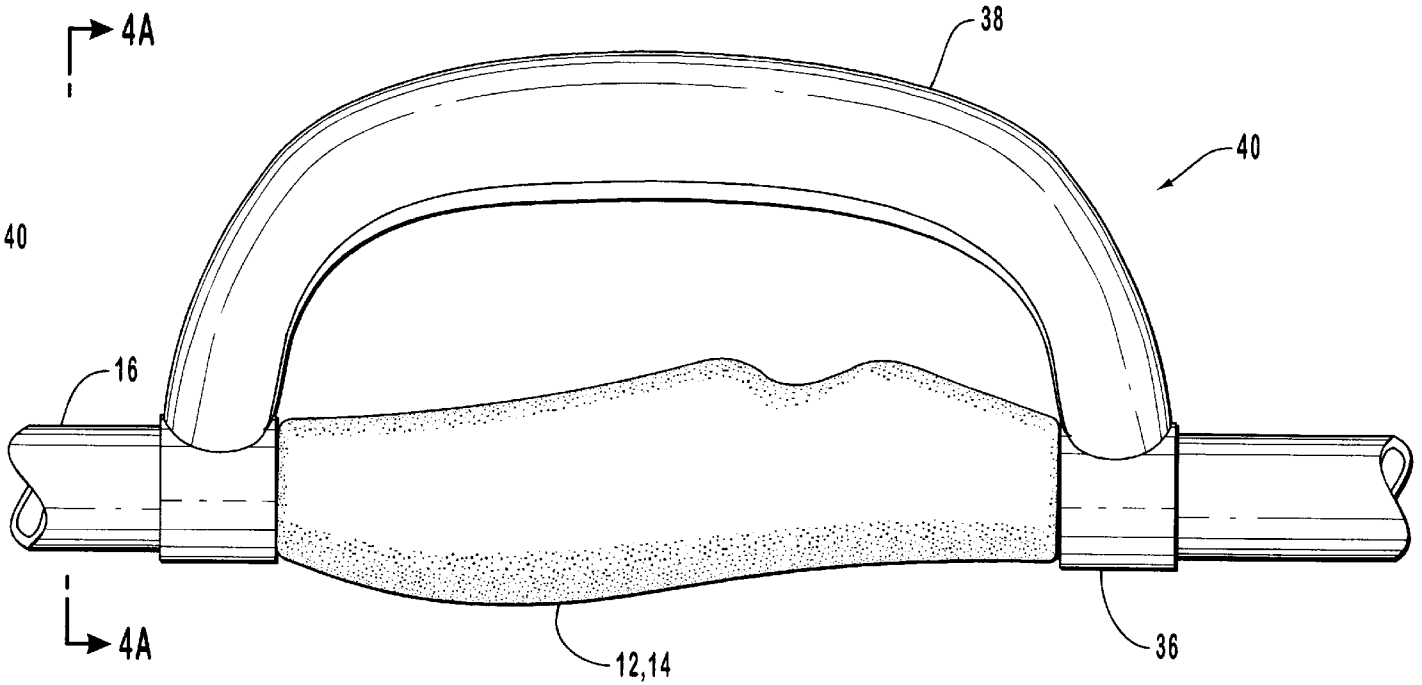
FIG. 4 is a view of the knuckle guard in accordance with an embodiment of the present invention.
Figure 4A:
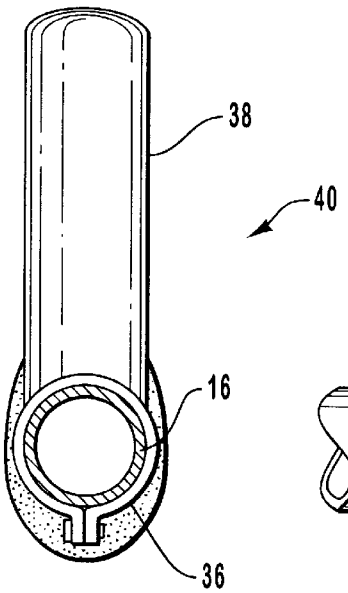

In an alternate embodiment, knuckle guards 40, depicted generally in FIG. 4, serve to protect the user's hands in the event of impact with rocks, branches or other obstacles that a kayaker may encounter, as well as further serving to properly orient the user's hands on the paddle. Knuckle guards 40 are preferably removably attachable to the ergonomic grip arrangement. It will be readily appreciated by those of skill in the art that the aforementioned removability feature may be effectuated by a variety of known devices including, but not limited to, screws, pins, clamps, and the like. As indicated in FIG. 4, the shield members 38 are joined to the left hand grip element 12 and the right hand grip element 14, respectively, by attachment members 36. In a preferred embodiment, attachment members 36 comprise clamps or the like, as indicated in FIGS. 4 and 4A. As further indicated in FIG. 4, the shield members 38 project outwardly so as to readily permit the user's hands to engage the left hand grip element 12 and the right hand grip element 14. The shield member as depicted in FIG. 4 shows a shield member having two points of attachment with the elongate shaft 16. It is contemplated that shield members may assume an L-shaped configuration and be attached to the shaft at only one point or may even be integrally formed with grip 12 as a single molded or assembled unit. Such embodiments are contemplated within the scope of the present invention.

Figure 7:
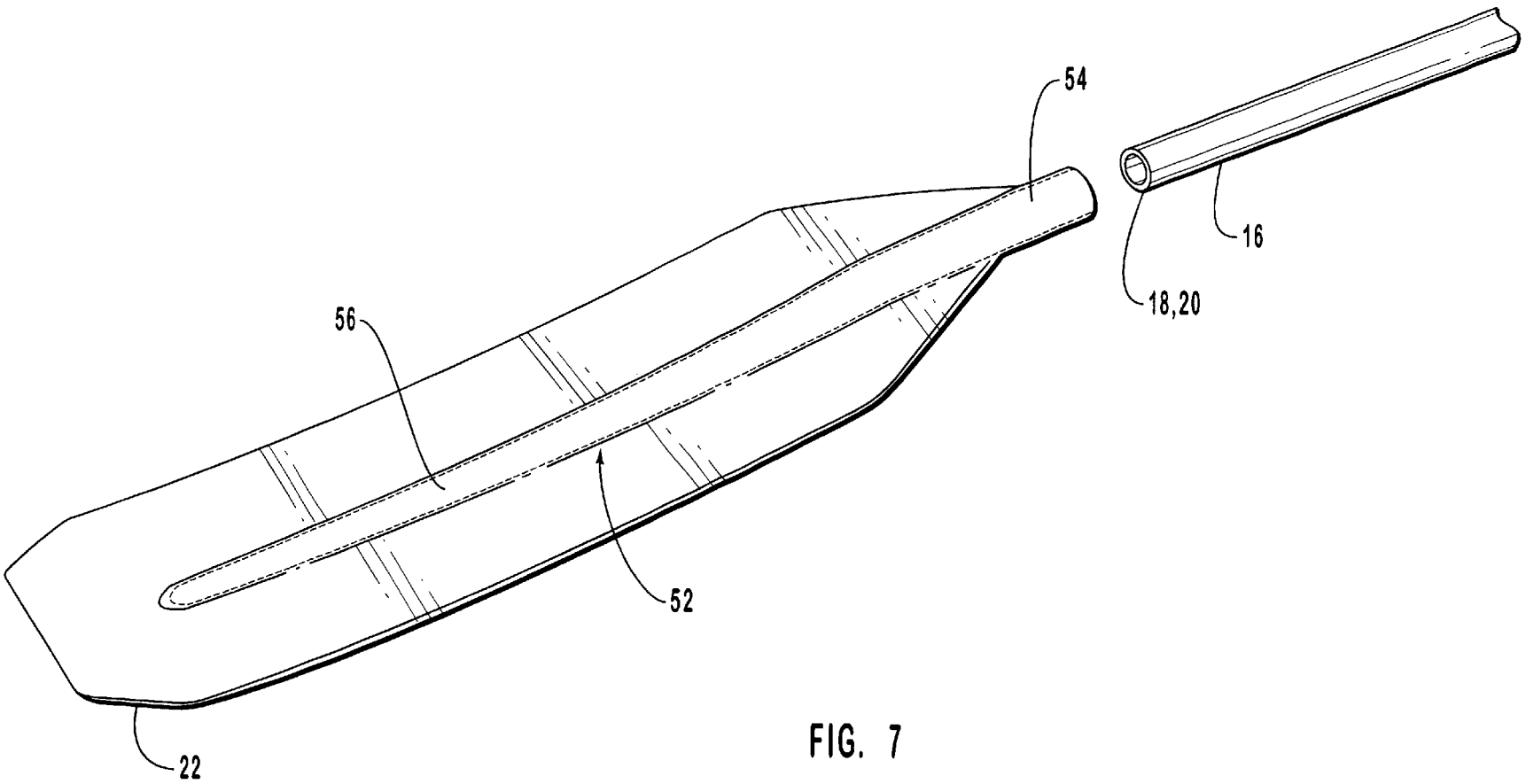
FIG. 7 depicts the hollow rib formed in the kayak paddle blades.

Finally, as indicated generally in FIG. 1, the blades 22 are fixedly attached to either end of the elongate shaft 16. In a preferred embodiment, each of the blades 22 has a hollow rib 52 formed therein, as indicated in FIG. 7. The hollow rib 52 extends substantially the length of the blade 22. The hollow rib 52 has a socket portion 54 to receive the first 18 and second 20 ends of the elongate shaft 16, the shaft ends being secured in the socket portions 54 by adhesive or the like. Adjacent to the socket portion 54, and communicating therewith, is a tapered chamber portion 56. The tapered chamber portion 56 serves to confine a quantity of air when the first 18 and second 20 ends of the elongate shaft 16 are inserted fully into the socket portions 54; the air thereby entrapped serves to facilitate flotation of the kayak paddle. Preferably, socket portions 54 are in the range of about three (3) inches long to about five (5) inches long, and tapered chamber portions 56 are in the range of about ten (10) inches long to about twelve (12) inches long.

Figure 5:
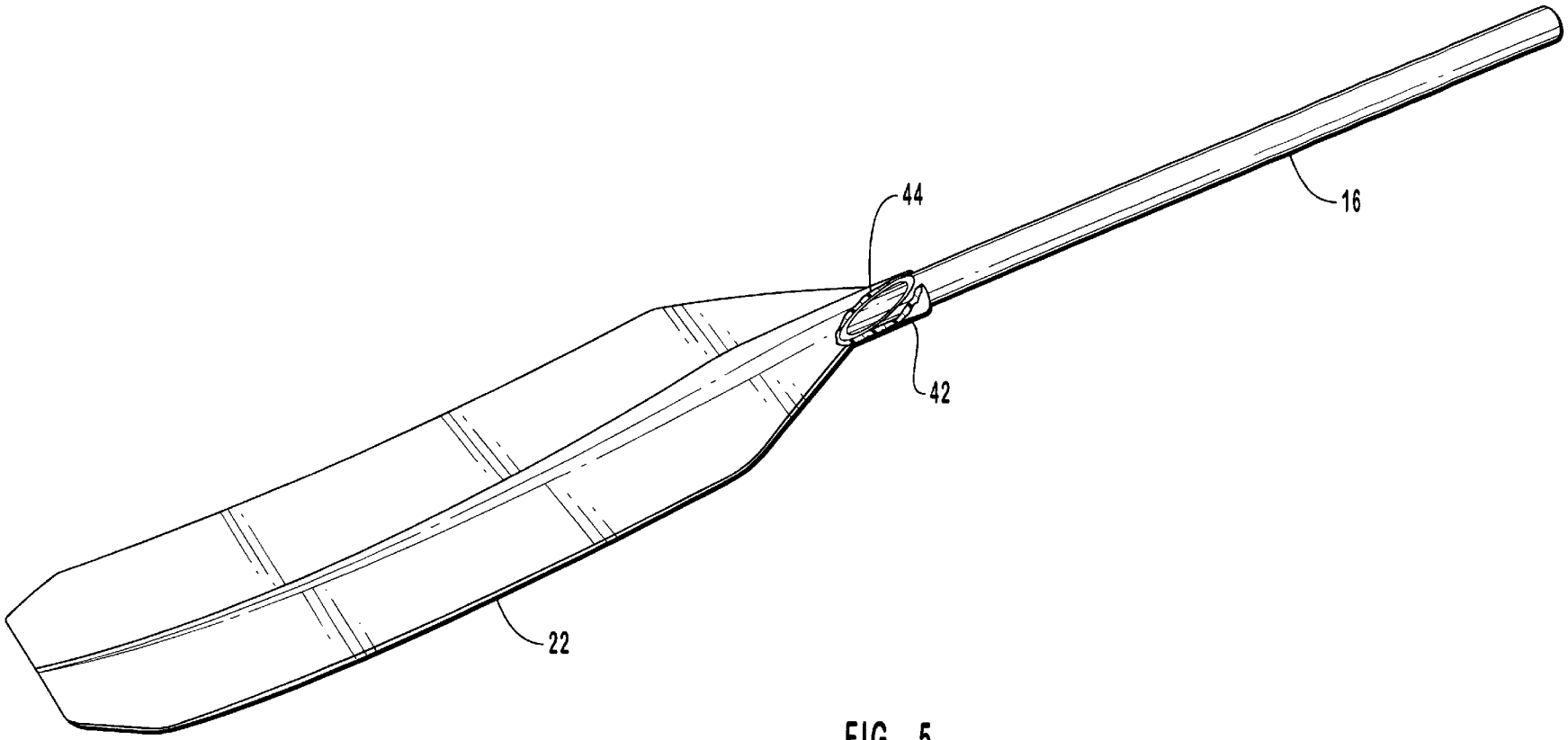
FIG. 5 is a view of the tapered socket in the paddle blade in accordance with an embodiment of the present invention.

In an alternate preferred embodiment, suitable means for fixedly attaching the blades 22 to the elongate shaft 16 include use of tapered shaft ends 24, in accord with FIG. 2, and blade sockets 42 which terminate in tapered ends 44, in accord with the cutaway drawing of FIG. 5. When the tapered shaft ends 24 (FIG. 2) are inserted into the sockets 42 (FIG. 5), the tapered shaft ends 24 mate with the tapered socket ends 44 (FIG. 5). In a preferred embodiment, suitable means for fixedly attaching the blades includes securing the tapered shaft ends 24 in the sockets 42 with the use of adhesive or the like. The tapered shaft ends 24 cooperate with the tapered socket ends 44 to ensure structural integrity of the connection, to minimize stress on the adhesive joint, and to effectively prevent rotation of the elongate shaft 16 and the paddle blades 22, with respect to each other.

It is also contemplated that as a result of the diverse individual physical parameters of kayakers and kayaks (e.g., shoulder width, preferred grip spacing, kayak width, kayak height above waterline, etc.), the present invention may be packaged as a kit of individual elements for assembly either by the end user or by a intermediary equipment retailer. Such collection of assembleable components is contemplated within the scope of the kayak paddle kit invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A kayak paddle, having an ergonomic grip to ensure consistent location and orientation of a user's hands, said kayak paddle comprising:

(a) an elongate straight shaft having a longitudinal axis and first and second opposed ends;

(b) a pair of blades, each of said pair of blades being fixedly attached to each of said first and second opposed ends of said elongate straight shaft;

(c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate straight shaft, wherein said right hand grip element and said left hand grip element are contoured to position said user's right and left hands, respectively, along axes oblique to said longitudinal straight axis of said elongate straight shaft, said axes forming acute angles with said longitudinal axis, said right hand grip element and said left hand grip element being positioned about said longitudinal axis so as to be in different planes.

2. The right hand grip element and the left hand grip element of claim 1, wherein said acute angles between said oblique axes and said longitudinal axis of said elongate straight shaft are in the range of about 6 degrees to about 8 degrees.

3. A kayak paddle, having an ergonomic grip to ensure consistent location and orientation of a user's hands, said kayak paddle comprising:

(a) an elongate straight shaft having a longitudinal axis and first and second opposed ends;

(b) a pair of blades, each of said pair of blades being fixedly attached to each of said first and second opposed ends of said elongate straight shaft;

(c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate straight shaft, wherein said right hand grip element and said left hand grip element are offset, relative to each other, about said longitudinal axis of said shaft, and wherein said left hand grip element and said right hand grip element are contoured to position said user's right and left hands, respectively, along axes oblique to said longitudinal axis of said elongate straight shaft.

4. The right hand grip element and the left hand grip element of claim 3, wherein said offset is in the range of about 45 degrees to about 90 degrees.

5. A kayak paddle, having an ergonomic grip to ensure consistent location and orientation of a user's hands, said kayak paddle comprising:

(a) an elongate straight shaft having a longitudinal axis and first and second opposed ends;

(b) a pair of blades, each of said pair of blades being fixedly attached to each of said first and second opposed ends of said elongate straight shaft;

(c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate straight shaft, wherein each of said right hand grip element and said left hand grip element further comprises at least one hand-orienting indentation and wherein said left hand grip element and said right hand grip element are contoured to position said user's right and left hands, respectively, along axes oblique to said longitudinal axis of said elongate straight shaft.

6. The right hand grip element and the left hand grip element according to claim 5, wherein said hand-orienting indentations comprise a notch having a vertex, said vertex serving as a seat for said user's index fingers for permitting consistent location and orientation of said user's hands on said elongate straight shaft.

7. The right hand grip element and the left hand grip element according to claim 5, wherein said hand-orienting indentations comprise a notch having a vertex, said vertex serving as a seat for said user's index fingers for substantially preventing said user's hands from sliding relative to said longitudinal axis of said shaft.

8. The right hand grip element and the left hand grip element according to claim 5, wherein said hand-orienting indentations comprise a notch having a vertex, said vertex serving as a seat for said user's index fingers for substantially preventing said elongate straight shaft from twisting in said user's hands.

9. A kayak paddle, having an ergonomic grip to ensure consistent location and orientation of a user's hands, said kayak paddle comprising:

(a) an elongate shaft having a longitudinal axis and first and second opposed ends;

(b) a pair of blades, each of said pair of blades, being fixedly attached to each of said first and second opposed ends of said elongate straight shaft;

(c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate shaft, wherein said ergonomic grip arrangement further comprises a pair of knuckle guards, said pair of knuckle guards having a shield member joined to said ergonomic grip arrangement by at least one attachment member, said shield members partially surrounding said ergonomic grip arrangement and projecting outward therefrom so as to readily permit said user's hands to engage said ergonomic grip arrangement.

10. The pair of knuckle guards according to claim 9, wherein said shield members and said attachment members are integrally formed with said ergonomic grip arrangement.

11. The pair of knuckle guards according to claim 9, wherein said pair of knuckle guards are removably attachable to said ergonomic grip arrangement.

12. A kayak paddle, having an ergonomic grip to ensure consistent location and orientation of a user's hands, said kayak paddle comprising:

(a) an elongate straight shaft having a longitudinal axis and first and second opposed ends;

(b) a pair of blades, each of said pair of blades being fixedly attached to each of said first and second opposed ends of said elongate straight shaft, wherein said first blade and said second blade of said pair of blades each further comprises a hollow rib formed therein, each of said hollow ribs having a socket portion so that said hollow rib of said first blade receives said first opposed end of said elongate straight shaft and said hollow rib of said second blade receives said second opposed end of said elongate straight shaft, said socket portions each communicating with respective chamber portions, said chamber portions each serving to confine a quantity of air so as to facilitate flotation of said kayak paddle (c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate straight shaft, wherein said left hand grip element and said right hand grip element are contoured to position said user's right and left hands, respectively, along axes oblique to said longitudinal axis of said elongate straight shaft.

13. The hollow ribs according to claim 12, wherein the socket portions of said hollow ribs are in the range of about 3 inches long to about 5 inches long, and the tapered chamber portions of said hollow ribs are in the range of about 10 inches long to about 12 inches long.

14. A kayak paddle, having an ergonomic grip to ensure consistent location and orientation of a user's hands, said kayak paddle comprising:

(a) an elongate straight shaft having a longitudinal axis and first and second opposed ends;

(b) a pair of blades, each of said pair of blades being fixedly attached to each of said first and second opposed ends of said elongate straight shaft;

(c) a means for fixedly attaching said pair of blades to said first and second opposed ends of said elongate straight shaft; wherein said means for fixedly attaching said first blade to said first opposed end of said elongate straight shaft and said second blade to said second opposed end of said elongate straight shaft comprises:

a first and second socket, said first socket receiving said first opposed end of said elongate straight shaft and said second socket receiving said second opposed end of said elongate straight shaft, said first and second sockets being substantially circular and said first socket being formed inside said first blade and said second socket being formed inside said second blade, said first and second sockets each terminating in a conical taper; a conical taper at each of said first and second opposed ends of said elongate straight shaft; means for securely fixing said first opposed end of said elongate straight shaft in said first socket and said second opposed end of said elongate straight shaft in said second socket; and d) an ergonomic grip arrangement having a left hand grip element and a right hand grip element, said ergonomic grip arrangement being mounted about said elongate straight shaft, wherein said left hand grip element and said right hand grip element are contoured to position said user's right and left hands, respectively, along axes oblique to said longitudinal axis of said elongate straight shaft.

15. The means according to claim 14, for fixedly attaching said pair of blades to said first and second opposed ends of said elongate straight shaft, wherein said means for securely fixing each of said first and second opposed ends of said elongate straight shaft in said pair of sockets comprises adhesive.

16. The means for fixedly attaching said pair of blades to said elongate straight shaft, according to claim 14, wherein said first and second opposed ends of said elongate straight shaft are fully inserted into said pair of sockets, said conically tapered ends of said elongate straight shaft correspondingly fitting with said conical taper of said pair of sockets, thereby affording structural integrity and preventing said pair of blades and said elongate straight shaft from rotating, relative to each other, about said longitudinal axis, said means for securely fixing each of said first and second opposed ends of said elongate straight shaft in said pair of sockets preventing said first and second opposed ends of said elongate straight shaft from being pulled from said pair of sockets.

17. A kayak paddle, having an ergonomic grip to ensure consistent location and orientation of a user's hands, said kayak paddle comprising:

(a) an elongate straight shaft having a longitudinal axis and first and second opposed ends, wherein a plurality of hand-locating offsets are formed in said elongate straight shaft;

(b) a pair of blades, each of said pair of blades being fixedly attached to each of said first and second opposed ends of said elongate straight shaft;

(c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate straight shaft, wherein said left hand grip element and said right hand grip element are contoured to position said user's right and left hands, respectively, along axes oblique to said longitudinal axis of said elongate straight shaft.

18. A kayak paddle, having an ergonomic grip to ensure consistent location and orientation of a user's hands, said kayak paddle comprising:

(a) an elongate straight shaft having a longitudinal axis and first and second opposed ends, wherein at least a portion of said elongate straight shaft has a generally oval, square, or polygonal cross-section;

(b) a pair of blades each of said pair of blades being fixedly attached to each of said first and second opposed ends of said elongate straight shaft;

(c) a means for fixedly attaching said pair of blades to said first and second opposed ends of said elongate straight shaft; and (d) an ergonomic grip arrangement having a left hand grip element and a right hand grip element, said ergonomic grip arrangement being mounted about said elongate straight shaft, wherein said left hand grip element and said right hand grip element are contoured to position said user's right and left hands, respectively, along axes oblique to said longitudinal axis of said elongate straight shaft.

19. A kayak paddle kit, having a grip arrangement to ensure consistent placement and orientation of the user's hands, said kayak paddle kit comprising:

(a) an elongate shaft having a longitudinal axis and first and second opposed ends;

(b) a pair of blades, one blade being fixedly attachable to each of said first and second opposed ends of said elongate shaft; and (c) an ergonomic grip arrangement having a left hand grip element and a right hand grip element, said ergonomic grip arrangement being mountable about said elongate shaft, further comprising a pair of knuckle guards, said pair of knuckle guards being joined to said ergonomic grip arrangement.

20. A kayak paddle kit, having a grip arrangement to ensure consistent placement and orientation of the user's hands, said kayak paddle kit comprising:

(a) an elongate straight shaft having a longitudinal axis and first and second opposed ends;

(b) a pair of blades, one blade being fixedly attachable to each of said first and second opposed ends of said elongate straight shaft; and (c) an ergonomic grip arrangement having a left hand grip element and a right hand grip element, said ergonomic grip arrangement being mountable about said elongate straight shaft, wherein each of said right hand grip element and said left hand grip element further comprises at least one hand-orienting indentation, and wherein said left hand grip element and said right hand grip element are contoured to position said user's right and left hands, respectively, along axes oblique to said longitudinal axis of said elongate straight shaft.

21. The right hand grip element and the left hand grip element according to claim 20, wherein said hand-orienting indentations comprise a notch having a vertex, said vertex serving as a seat for said user's index fingers.

22. A kayak paddle kit, having a grip arrangement to ensure consistent placement and orientation of the user's hands, said kayak paddle kit comprising:

(a) an elongate straight shaft having a longitudinal axis and first and second opposed ends;

(b) a pair of blades, one blade being fixedly attachable to each of said first and second opposed ends of said elongate straight shaft; and (c) an ergonomic grip arrangement having a left hand grip element and a right hand grip element, said ergonomic grip arrangement being mountable about said elongate straight shaft, wherein said right hand grip element and said left hand grip element are contoured to position said right hand of said user and said left hand of said user, respectively, along axes offset from said longitudinal straight axis of said elongate straight shaft so as to form acute angles therewith, said right hand grip element and said left hand grip element being positioned about said longitudinal axis so as to be in different planes.

23. The right hand grip element and the left hand grip element of claim 22, wherein said acute angles between said oblique axes and said longitudinal axis of said elongate straight shaft are in the range of about 6 degrees to about 8 degrees.

24. A kayak paddle kit, having a grip arrangement to ensure consistent placement and orientation of the user's hands, said kayak paddle kit comprising:

(a) an elongate straight shaft having a longitudinal axis and first and second opposed ends;

(b) a pair of blades, one blade being fixedly attachable to each of said first and second opposed ends of said elongate straight shaft; and (c) an ergonomic grip arrangement having a left hand grip element and a right hand grip element, said ergonomic grip arrangement being mountable about said elongate straight shaft, wherein said left hand grip element and said right hand grip element are offset, relative to each other, about said longitudinal axis of said shaft, and wherein said left hand grip element and said right hand grip element are contoured to position said user's right and left hands, respectively, along axes oblique to said longitudinal axis of said elongate straight shaft.

25. The right hand grip element and the left hand grip element of claim 24, wherein said offset is in the range of about 45 degrees to about 90 degrees.

26. A kayak paddle kit, having a grip arrangement to ensure consistent placement and orientation of the user's hands, said kayak paddle kit comprising:

(a) an elongate straight shaft having a longitudinal axis and first and second opposed ends, wherein at least a portion of said elongate straight shaft has a generally oval, square, or polygonal cross-section;

(b) a pair of blades, one blade being fixedly attachable to each of said first and second opposed ends of said elongate straight shaft; and (c) an ergonomic grip arrangement having a left hand grip element and a right hand grip element, said ergonomic grip arrangement being mountable about said elongate straight shaft, wherein said left hand grip element and said right hand grip element are contoured to position said user's right and left hands, respectively, along axes oblique to said longitudinal axis of said elongate straight shaft.

27. A kayak paddle kit, having a grip arrangement to ensure consistent placement and orientation of the user's hands, said kayak paddle kit comprising:

(a) an elongate straight shaft having a longitudinal axis and first and second opposed ends;

(b) a pair of blades, one blade being fixedly attachable to each of said first and second opposed ends of said elongate straight shaft, wherein said first blade and said second blade of said pair of blades each further comprises a hollow rib formed therein, said hollow rib of said first blade being substantially as long as said first blade and said hollow rib of said second blade being substantially as long as said second blade, each of said hollow ribs having a socket portion so that said hollow rib of said first blade receives said first opposed end of said elongate straight shaft and said hollow rib of said second blade receives said second opposed end of said elongate straight shaft, said socket portions each communicating with respective chamber portions, said chamber portions each serving to confine a quantity of air so as to facilitate flotation of said kayak paddle; and (c) an ergonomic grip arrangement having a left hand grip element and a right hand grip element, said ergonomic grip arrangement being mountable about said elongate straight shaft, wherein said left hand grip element and said right hand grip element are contoured to position said user's right and left hands, respectively, along axes oblique to said longitudinal axis of said elongate straight shaft.

* * * * *